United States Patent [19]

Beretta

[11] Patent Number: 4,977,814

[45] Date of Patent: Dec. 18, 1990

[54] AUTOMATIC SAFETY DEVICE FOR FIRE ARMS

[75] Inventor: Pier G. Beretta, Gardone V.T., Italy

[73] Assignee: Fabbrica D'Armi P. Beretta S.P.A., Italy

[21] Appl. No.: 462,812

[22] Filed: Jan. 10, 1990

[30] Foreign Application Priority Data

Jan. 11, 1989 [IT] Italy ..... 5101 A/89

[51] Int. Cl.[5] ..... F41A 3/72; F41A 7/02; F41A 17/42; F41A 17/76

[52] U.S. Cl. ..... 89/1.4

[58] Field of Search ..... 89/1.4

[56] References Cited

U.S. PATENT DOCUMENTS 2,717,532 9/1955 Ramseyer ..... 89/1.4
3,352,206 11/1967 Draper ..... 89/1.4
3,938,422 2/1976 Tellie ..... 89/1.4
4,261,247 4/1981 Reynolds ..... 89/1.4
4,702,144 10/1987 Zedrosser ..... 89/1.4

*Primary Examiner*—David H. Brown
*Attorney, Agent, or Firm*—McGlew and Tuttle

[57] ABSTRACT

The invention relates to an automatic safety device for fire arms, in particular for automatic guns to be operated starting from their open-bolt position. A movable slider (12) and a rocking catch lever (19), both assembled to a support on the bolt (11), cooperate in order to allow the lever to engage in a toothed section (15) on the breech (10) and thus prevent the bolt from moving forwards in case of a faulty move, of a release or missed catch during its manual cocking and to maintain the device out of action while the arm is operated wither automatically or manually. Owing to this structure the possibility of uncontrolled or accidental shots is actually eliminated.

5 Claims, 5 Drawing Sheets

AUTOMATIC SAFETY DEVICE FOR FIRE ARMS

The present invention generally concerns those fire arms which are operated starting from their open-bolt position, and in particular an automatic safety device for said fire arms and especially designed for automatic guns.

Fire arms which are operated starting from their open-bolt position have to be first manually cocked by taking back the bolt till it is engaged by the tripping mechanism of the arm. This operation may however cause an accidental and therefore dangerous shot. In fact, a faulty or incomplete manual move of the bolt or its release during its cocking or a shock taking the ammunition into the barrel causing an uncontrolled shot cannot be excluded.

The purpose of the present invention is instead to prevent such an eventuality and thus its possible consequences.

Specifically, it is the purpose of the present invention to make available an automatic safety device for the above mentioned type of fire arms which is able to immediately stop the bolt in whichever position in case of a faulty or incomplete operation or in case it moves back by accident, in order to prevent said bolt from advancing before it is safely engaged in the tripping mechanism of the arm; thus "obliging" the operator, while he is cocking the arm, to take the boltlock on the tripping mechanism.

The device is therefore performinng the following functions owing to its special design.

It goes into action only the moment the arm is cocked: while the arm is operating either automatically or with individual shots, the whole safety device is cut off and thus inactive;

With the proposed solution the bolt of the arm cannot be manually displaced without activating the safety device to allow it to exert its functions;

during manual cocking the device allows the bolt to move in one directions only, i.e. its rearward motion towards the tripping mechnism to take it into its correct cocked position;

in case of a faulty or incomplete move or if the boltlock is released too soon, the safety device makes any accidental shot impossible;

very advantageously, said safety device can be assembled not only on new arms, but also to already used automatic guns to transform them and improve their safety.

More details of the invention will be more evident in the following description made with reference to the enclosed drawings which are merely illustrative and by no means restrictive and where:

Figure 1:
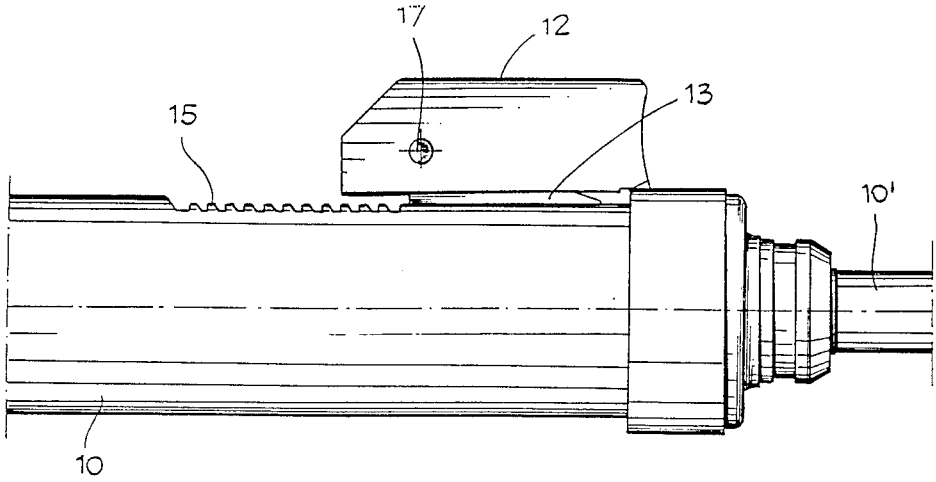
FIG. 1 shows a partial elevation of a fire arm in idle position, fitted with a safety device.

Said drawing shows a breech 10 with barrel 10' of a fire arm, e.g. an automatic gun, and with a bolt 11 which is manually displaceable, by means of a slider 12, from a front and closed position resting against the barrel to a rear and open position defined by a tripping mechanism the moment in which the arm is to be used.

Said slider 12 is assembled to the breech 11 through a support 13 which is fixed to the breech and can thus be displaced together with it. Slider 12 is assembled and guided on support 13 and sliding in the direction in which the bolt is displaceable. Support 13 is inserted into a longitudinal slot 14 cut into the breech 10 to allow the opening and closing displacements of the bolt 11. At least at one end of said slot 14 the breech 10 is fitted with a sequence of teeth 15 sloping transversally to the sense of displacement of bolt 11.

In support 13 a slot 16 which is parallel to the axis of bolt 11 is provided to receive a pin 17 traversing the support 13 and thus the slider 12. Slot 16 and pin 17 cooperate in delimiting the sliding motions of slider 12 on support 13 and taking back said support with the bolt when the latter has to be manually taken into its open position. In the illustrated embodiment said rearward displacement of support 13 with bolt 11 is actually obtained by placing the front end 12' of the slider against the head of support 13.

Between support 13 and slider 12 a spring 18 is normally keeping the slider 12 displaced to the front end of support 13, while the pin 17 is pushed against the front end of slot 16.

In addition, on support 13 a rocking catch lever 19 is pivoted on a pin 20, said pin crossing the direction in which bolt 11 is displaced. The front end of said rocking lever 19, i.e. its end directed towards the front end of the breech 10, is fitted with a tooth 21 designed to interact, from back to forth only, with the toothing 15 on the breech, while its rear end 22 is designed to interact with pin 17, as will be explained here under. Said lever 19 is also subject to a spring 23 to normally keep its tooth 21 displaced towards the toothing 15 and its end 22 towards pin 17 or to engage it on said pin.

The operation of the safety device will now be described by specifying some of its characteristic operational stages.

A. Arm in neutral position

Figure 2:
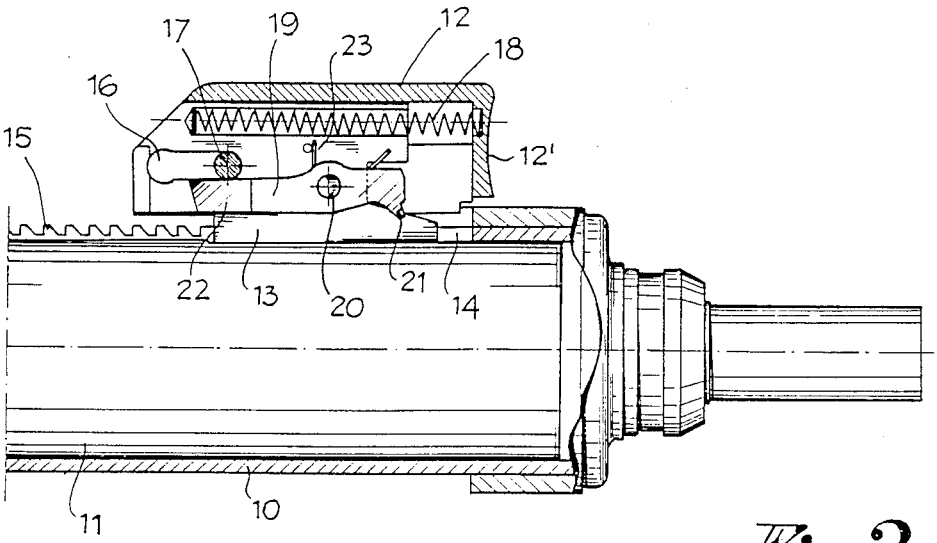
FIG. 2 shows a sectional view of an arm with its bolt in forward closed position and with its safety device in idle position.

In FIGS. 1 and 2 the arm is shown in its neutral position: bolt 11 is in its advanced position and resting against the rear end of barrel 10'; the safety device is released.

In particular, the position of the components of said device is:

slider 12 is in its advanced position owing to the pressure exercised by spring 18 and kept in this position by pin 17 cooperating with slot 16 in support 13;

catch tooth 21 of rocking lever 19 is lifted above the toothing 15 on breech 10; and tail 22 of said lever 19 is resting against pin 17 in slider 12.

B. Manual cocking

The first stage of manual cocking comprises a pressure exercised in the direction of arrow F on slider 12 to slightly displace it (by 10 mm approx.) on its support 13 and thus in respect to bolt 11, support and bolt not moving during this first stage.

Figure 3:
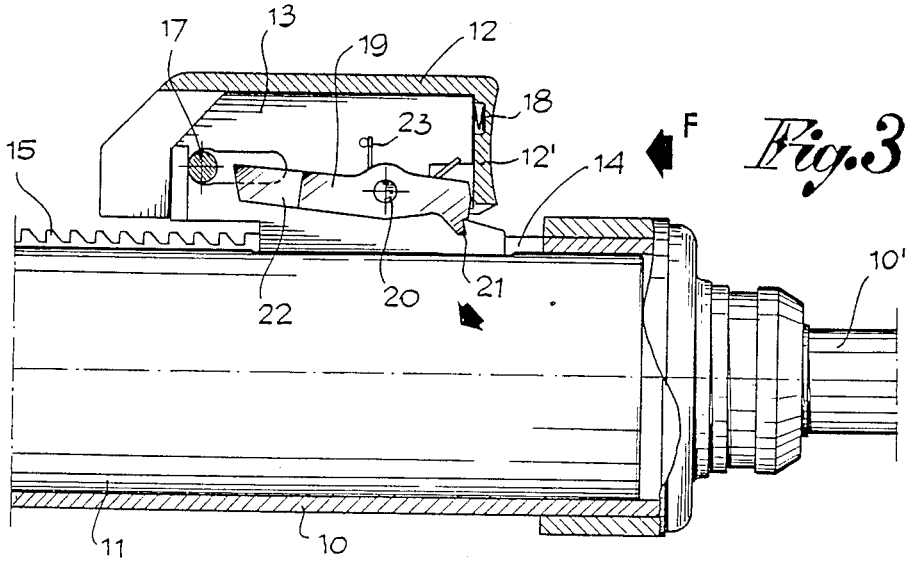
FIGS. 3,4,5,6,7 and 8 show a sequence of intermediate positions of the bolt and the safety device during the manual cocking operation.

After that, when slider 12 has compressed the spring 18 like shown in FIG. 3, it is in such a position that it disengages tail 22 of rocking lever 19 from pin 17 in the slider: now lever 19, pushed by its spring 23, is able to move on till its front tooth 21 is resting on the outer surface of breech 10, i.e. on its section comprising the toothing 15, while its tail end 22 is level with pin 17 of the slider.

While the manual cocking is continued, slider 12, after eliminating the space (10 mm approx.) separating its front end 12' from the head of support 13, will start to actually push back bolt 11.

Figure 4:
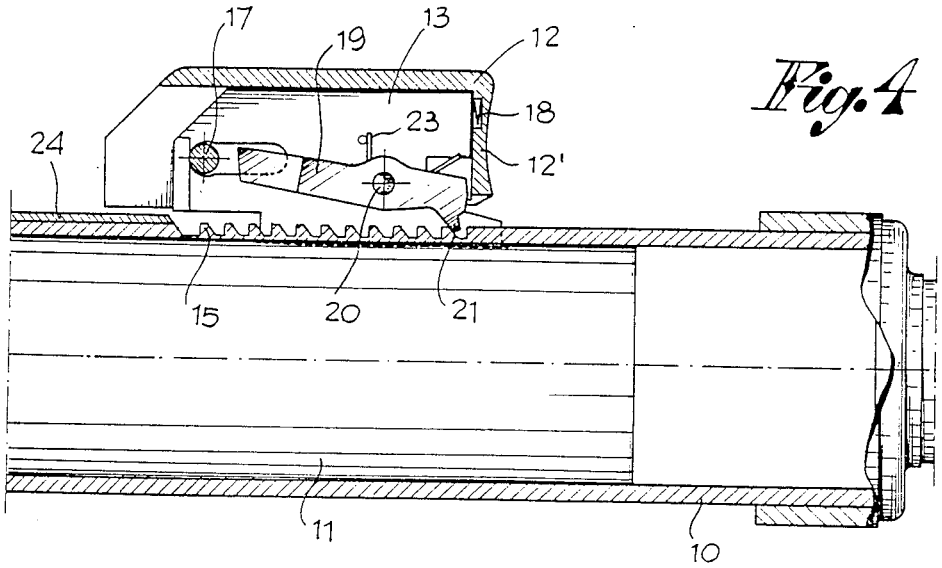
Figure 5:
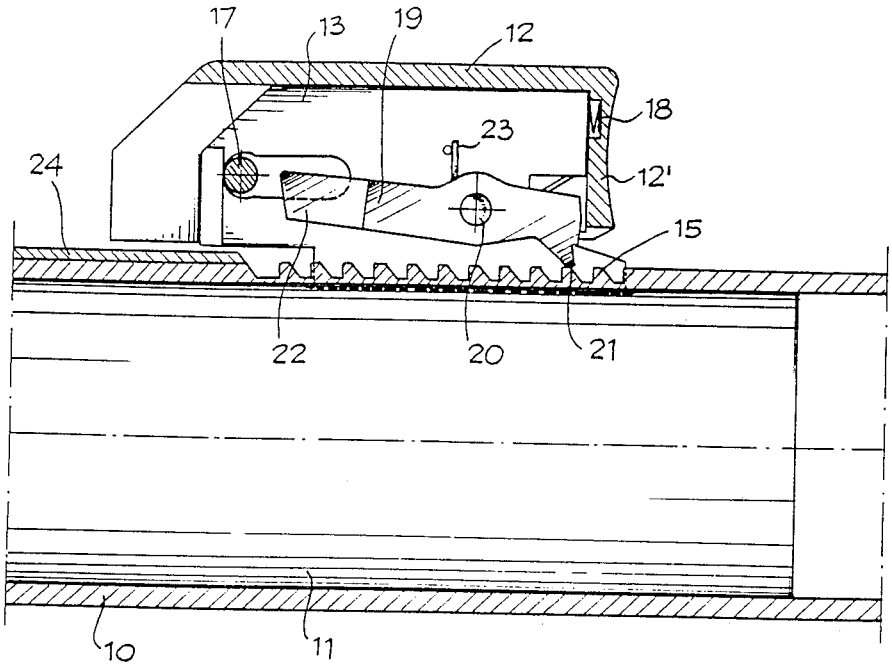
Figure 6:
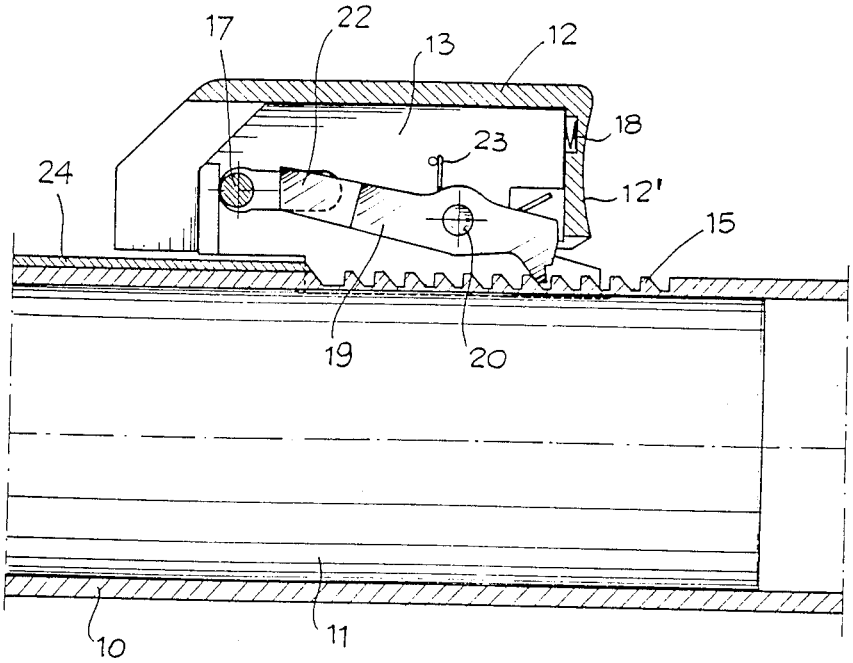

As shown in FIGS. 4 and 5, owing to spring 23, the front tooth 21 of rocking lever 19 is constantly kept in contact with breech 10, while its rear end 22 is at interacting level with pin 17. As the backward motion is continued (see FIG. 6) catch tooth 21 of lever 19 is travelling on the toothing 15 till the end of the cocking operation, i.e. till bolt 11 is catched and fastened by the (not represented) tripping mechanism of the arm.

Before reaching this final condition of the bolt allowing the actual use of the arm, some possibilities ought to be taken into consideration.

B. Faulty move of the operator

Figure 7:
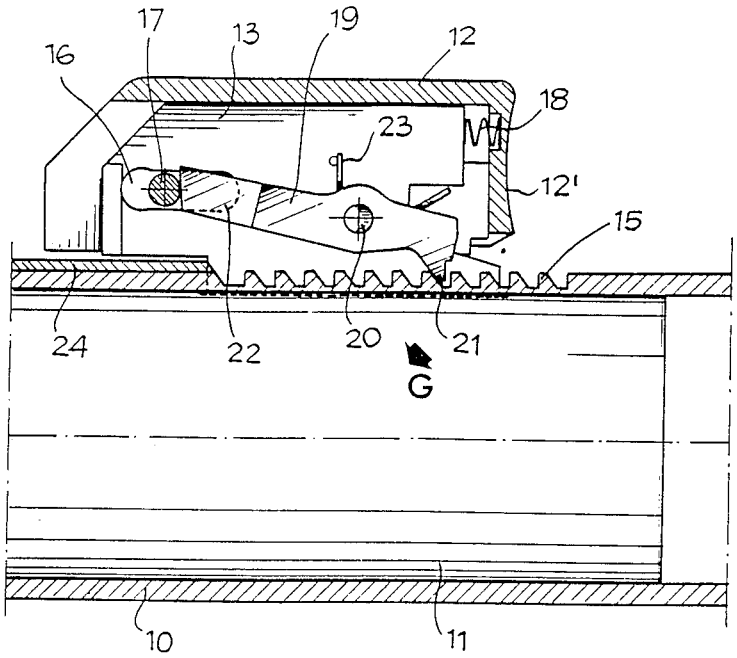
Figure 8:
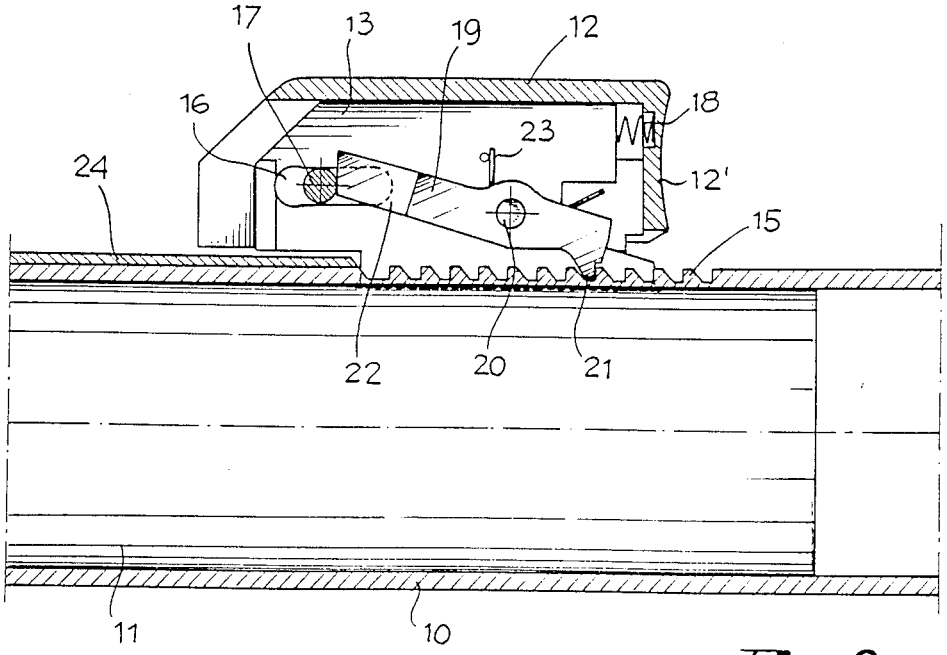

If during manual cocking the operator accidentally lets go the slider 12 or lets it go being erroneously convinced it has reached its correct position, he will bring about the situation shown in FIGS. 7 and 8. In fact, as the spring 18 of slider 12 is no longer compressed by the operator it will extend and take slider 12 to its advanced position on support 13. But by moving on slider 12 takes pin 17 towards the tail end 22 of the rocking lever 19 which, as said before, is thus engaged by said pin. In consequence, said rocking lever is obliged to move in the direction of arrow G in FIG. 7 and thus engage tooth 21 in the toothing 15 on breech 10 (see FIG. 8). Lock 11 is therefore immediately stopped in the position to which it has been displaced and where it has been abandoned, thus being absolutely unable to reach its closed position.

The arm is thus in a static condition of partial opening of its bolt and at any rate in a safe position, while the trigger is fully indepennt from any motion of the bolt.

B.2 Continuation of the cocking operation (after an eventual blocking as in B.1.)

As it can be seen in FIG. 8, it is not possible to act on the safety device to release it and allow the bolt 11 to advance towards the barrel 10' into its closed position. In fact, any action exerted on slider 12 in order to push on the bolt 11 will only result in a tighter engagement of the catch tooth 21 of rocking lever 19 in the toothing 15 on the breech. Thus the only thing the operator can do is to restart the manual cocking operation by grasping the slider 12 and push it backwards and when its front end 12' is in tight contact with support 13 he will be able to move back the bolt till it is correctly engaged in the tripping mechanism.

B.3. Correct cocking (interception of the bolt by the tripping mechanism).

It is now obvious that the operator is still "obliged" to displaced the lock towards the tripping mechanism, as otherwise he will by no means able to use the arm for shooting.

Figure 9:
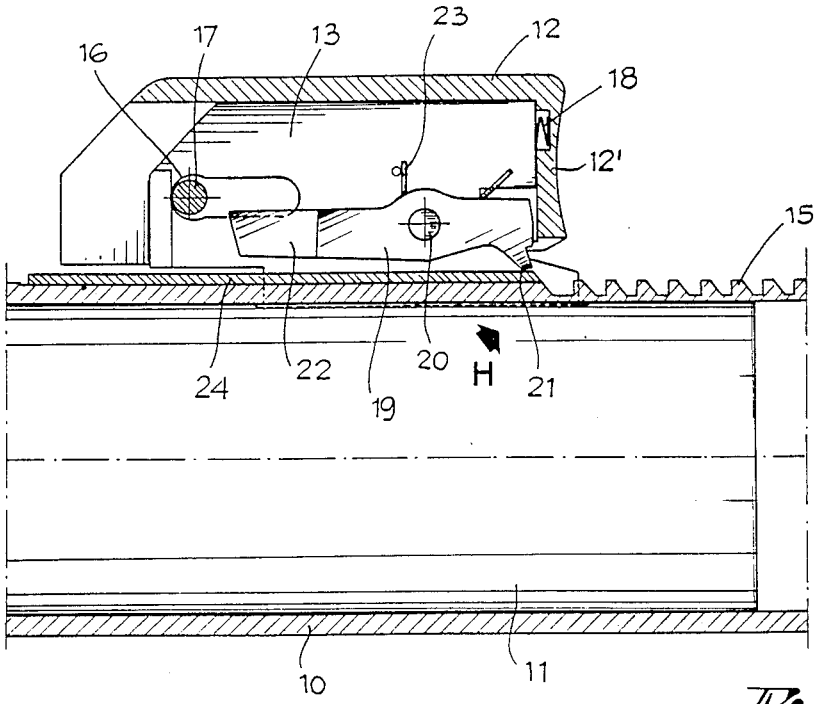
FIGS. 9 and 10 show the device while it is being inactivated and in idle position at the end of manual cocking respectively.
Figure 10:
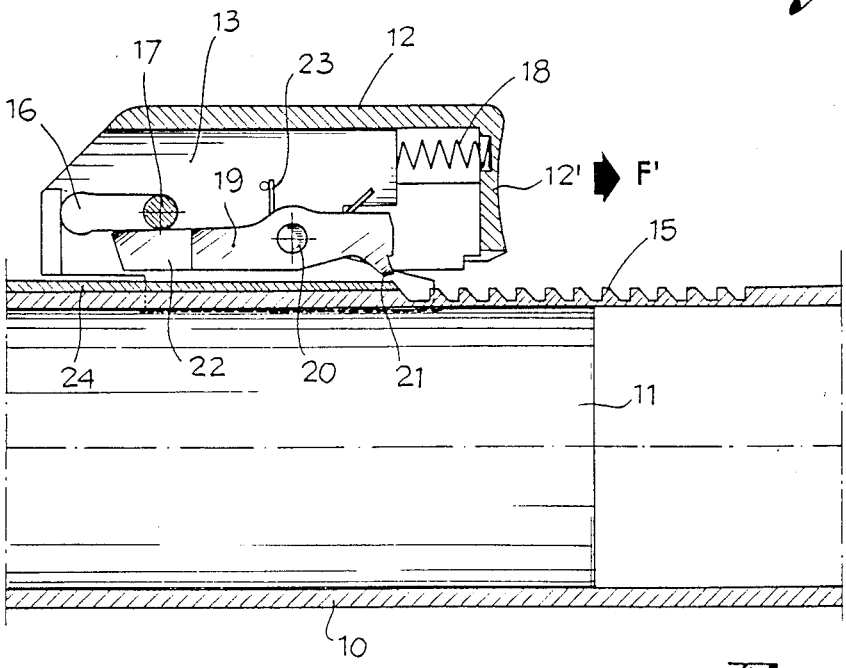

On the other hand, the safety device is inactivated only with the bolt engaged in the tripping mechanism. To this purpose a release plate 24 is fitted on the breech 11 after the rear end of toothing 15, said plate 24 interacting with the locking lever 19 so as to lift and displace it into its neutral position as soon as the bolt has reached its correct cocked position. The interaction of the release plate 24 with the rocking lever 19 is shown in FIG. 9 of the drawing where it can be seen how, on one hand, the catch tooth 21 of lever 19 is displaced by plate 14—arrow H—above toothing 15 and, on the other hand, tail 22 of said lever is situated below pin 17 of slider 12.

That is why, once the slider is no longer subject to the manual traction of the operator, it is pushed on by spring 18 and goes back to its rest position—see arrow F—taking pin 17 against the top part of the tail end 22 of lever 19, thus keeping said lever out of action (as it was at the beginnig of the manual cocking operation (see FIG. 2).

Now the arm is ready for shooting both single shots and automatically, while the safety device stays totally inert but always ready to exert its function as soon as the bolt of the arm has to be cocked again.

I claim:

1. Automatic safety device for fire arms, like automatic guns, to be operated starting with their bolt is in open position both for automatic shooting and single shots, said bolt (11) being manually displaceable by means of a slider (12) in a breech (10) starting from an advanced closed position against the barrel and ending in an open rear position defined by a tripping mechanism, characterized in that to the bolt (11) a support (13) is fixed and extending into a longitudinal slot (14) cut into breech (10), in that at least at one side of said slot (14) the breech is fitted with a toothing (15) made of a sequence of teeth transversely oriented with respect to the direction in which said bolt is displaced, in that said slider (12) is assembled to said support (13) and able to slide between an advanced position where it is axially disengaged from the support and a rear position where it is axially engaging said support in order to take the bolt (11) to its rear, open position, and in that on said support (13) a rocking catch lever (19) is assembled, one end of said lever (19) being fitted with a catch tooth (21) designed to interact with said toothing (15), while its opposite tail end (22) is designed to interact with a pin (17) fixed and displaceable with slider (12) on support (13), in that the slider (12) and the rocking lever (19) cooperate in order to allow said tooth (21) of lever (19) to engage in said toothing (15) so as to prevent the bolt (11) from advancing in case of a faulty move or release during its motion towards its rear open position, and to maintain said lever (19) in an inactive position as long as the arm is used for automatic shooting or single shots, said lever being inactivated when the bolt is in its rear position on the tripping mechanism and its catch tooth (21) is not engaged in said toothing (15).

2. Device according to claim 1, where on breech (10) a plate (24) is fixed, which interacts with the rocking catch lever (19) in order to inactivate it by moving off its catch tooth (21) from toothing (15) when the bolt is in its rear position on the tripping mechanism.

3. Device according to claim 1, where a part (12') of said slider (12) is designed to contact support (13) when slider (12) is in its rear position to displace the bolt (11) towards its open position, and where a recuperating spring (23) is placed between slider (12) and support (13) to maintain and retake slider (12) in its advanced position where it is no longer engaging said support (13).

4. Device according to claims 1 or 3, where said rocking catch lever (19) is subject to a spring (23) tending to maintain and displace said catch tooth (21) of lever (19) towards the toothing (15) and tail end (22) of said lever (19) at an interacting level with said pin (17) on said slider.

5. Device according to claim 4, where the tail end (22) of said lever (19) and said pin (17) are at the same level and spaced between each other when said slider is in its rear position on the support while the bolt is displaced towards its open position, and where said tail end (22) of lever (19) and pin (17) are at the same level and contacting each other when said slider (12) is in its advanced position and the catch tooth (21) of said lever (19) is interacting with toothing (15), said tail (22) of lever (19) resting instead below pin (17) when slider (12) is in advanced position and said lever is inactivated, so as to keep catch tooth (21) off the toothing (15) on breech (10).

* * * * *